US007391396B2

(12) United States Patent
Igarashi

(10) Patent No.: US 7,391,396 B2
(45) Date of Patent: Jun. 24, 2008

(54) DISPLAY DEVICE AND DRIVING METHOD THEREOF

(75) Inventor: Yoichi Igarashi, Mobara (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 563 days.

(21) Appl. No.: 10/876,678

(22) Filed: Jun. 28, 2004

(65) Prior Publication Data

US 2004/0263462 A1 Dec. 30, 2004

(30) Foreign Application Priority Data

Jun. 27, 2003 (JP) ..... 2003-183862
May 19, 2004 (JP) ..... 2004-149575

(51) Int. Cl.
*G09G 3/36* (2006.01)
*G09G 5/10* (2006.01)

(52) U.S. Cl. ..... 345/87; 345/690

(58) Field of Classification Search ..... 345/98, 345/690, 87

See application file for complete search history.

(56) References Cited

U.S. PATENT DOCUMENTS 6,771,243 B2 * 8/2004 Hirohata ..... 345/89
2001/0048432 A1 * 12/2001 Taniai et al. ..... 345/213

* cited by examiner

*Primary Examiner*—Amr A. Awad
*Assistant Examiner*—Randal Willis
(74) *Attorney, Agent, or Firm*—Antonelli, Terry, Stout & Kraus, LLP.

(57) ABSTRACT

In a display device, input display data processed by an input processing circuit is stored in a frame memory as first video data. Next-inputted video data is stored in another frame memory as second video data. The stored first video data is read out as video signals of a first field in response to a double-speed clock signal and is supplied to respective drain drivers. A comparison circuit compares second video data and first video data in the frame memory for each pixel. An output data processing circuit is controlled based on the comparison result. When second video data is darker than first video data, black display data is supplied to respective drain drivers as display data of the second field, while when second video data is brighter than first video data, white display data is supplied to respective drain drivers as display data of the second field.

9 Claims, 12 Drawing Sheets

DISPLAY DEVICE AND DRIVING METHOD THEREOF

BACKGROUND OF THE INVENTION

The present invention relates to a display device, and, more particularly, to a display device and a method of driving a display device so as to achieve high luminance and excellent motion picture display characteristics.

Flat panel type display devices, such as a liquid crystal display device, a plasma display device, a field emission display device, an organic light emitting display device and the like have been popularly used as color monitors for computers or other information equipment, or as display devices in television receiver sets. Among these flat panel type display devices, there has been a so-called hold-type display device which operates on the basis of the light emitting characteristics of pixels. The liquid crystal display device and the plasma display device are typical examples of a hold-type image display device. For example, the liquid crystal display device displays images with the following constitution and manner of operation.

FIG. 9 is a block diagram which illustrates the general characteristics of the display panel and the driving system of the typical active matrix type liquid crystal display device. This type of liquid crystal display device includes a liquid crystal display panel PNL. Further, the liquid crystal display device includes, on the periphery of the liquid crystal display panel PNL, a driving circuit (constituted of an IC chip or the like) which drives display signal lines DL (video signal lines, data lines, drain signal lines, drain lines or simply referred to as signal lines), that is, a display signal driving circuit (hereinafter, also referred to as a drain driver) DR, and a driving circuit (constituted of an IC chip or the like) which drives display scanning lines GL (gate signal lines, gate lines, or also simply referred to as scanning lines), that is, a display scanning line driving circuit (hereinafter also referred to as a gate driver) GR.

Further, the liquid crystal display device includes a display control circuit CRL, which constitutes display control means for supplying display data DATAin for displaying images, control signals (various clock signals including dot clocks CL, display timing signals DTMG, vertical synchronizing signals VSYNC, horizontal synchronizing signals HSYNC and the like), gray scale voltages and the like to the drain driver DR and the gate driver GR, and a power source circuit PWU. The display control circuit CRL is provided with a timing controller Tcon which generates various display timing signals for controlling the display. Pixels PX are arranged on crossing portions where the gate lines GL and the drain lines DL cross each other.

The input display data DATAin that is transmitted from an external signal source (a host computer), such as a computer, a personal computer or a television image receiving circuit, and various voltage signals, such as the dot clocks DCLK, display timing signals DTMG, the vertical synchronizing signals VSYNC, and the horizontal synchronizing signals HSYNC, are inputted to the display control circuit CRL. The display control circuit CRL includes a gray scale reference voltage generating part and the like (not shown in the drawing) besides the timing controller Tcon, and it converts the input display data DATAin and the various voltage signals from the outside into output data (display data) DATAout in a form suitable for display on the liquid crystal display panel PNL. The display data DATAout and the various clock signals CL are supplied to the drain drivers DR and the gate drivers GR in the manner shown in the drawing. In such a constitution, a carry output CRY of the preceding stage of the drain driver DR is directly supplied to the carry input of the drain driver of the succeeding stage. Reference symbol DB indicates a data bus of the display data DATAout.

The liquid crystal display device having such a constitution has been steadily replacing a cathode ray tube (CRT) display due to its beneficial features, such as low power consumption. The acceleration of such replacement is brought about by technological innovations which have led to enhancement of the image quality of the liquid crystal display device. Particularly, in recent years, a demand for motion picture display, as represented by a television image, is becoming stronger, and improvements have been made in liquid crystal materials and driving methods to satisfy this demand.

However, while the CRT employs an impulse type light emission by electron beam scanning using an electron gun, as mentioned previously, the liquid crystal display device employs a hold type light emission using a backlight system or the like, in which a linear lamp (a fluorescent lamp) or the like is used as an illumination light source; and, hence, it has been considered difficult for the liquid crystal display device to produce a complete motion picture display. That is, when a motion picture display is produced using a liquid crystal display device, due to the holding characteristics thereof, so-called motion picture profile deterioration (generally referred to as "blurring" or "motion picture blurring") is generated, and, hence, the image quality is degraded. The phenomenon is not limited to a liquid crystal display device and is generated in the same manner in a plasma display device or the like, for example.

SUMMARY OF THE INVENTION

FIG. 10A to FIG. 10D are diagrams illustrating the mechanism which results in the generation of motion picture profile deterioration when a motion picture is displayed using a display device having holding characteristics, such as a liquid crystal display device. FIG. 10A shows a case in which a black display, which moves in the direction of an arrow A, is produced on a portion of a background screen of the liquid crystal display device LCD; FIG. 10B shows a black/white boundary portion of the portion in an enlarged manner; FIG. 10C illustrates a cause of the motion picture profile deterioration; and FIG. 10D shows the black/white boundary portion in an enlarged manner in the same manner as FIG. 10B, which shows a motion picture profile deteriorated state. In these drawings, a unit square indicates a pixel.

Referring to FIG. 10C, which displays one row of the black/white boundary portion shown in FIG. 10B time-sequentially, along with the movement of a display image in the direction of the arrow A in FIG. 10A, a line of vision moves like the arrow B, in which is drawn in the right downward oblique direction FIG. 10C of in the drawing. Also, in the movement of the display within one frame, the luminance of each pixel displayed during the period is held. Since the luminance is obtained by integrating the luminance of the pixels, the motion picture profile deterioration shown in FIG. 10D is generated.

In the above-mentioned hold-type display device, such as a liquid crystal display device, a so-called "hold-type" display which displays the image over one frame period is produced. On the other hand, in a CRT, a so-called "impulse-type" display, which displays an image only for a moment and displays black during the remaining period, is produced. The cause which brings about the blurring of the image when the motion picture is displayed using a hold-type display device is strongly influenced by the above-mentioned hold-type characteristic. Accordingly, if an impulse-type display can be realized in this type of device, it is possible for the hold-type display device to realize a high-definition display with no motion picture blurring.

As techniques which have been proposed to overcome this drawback, a method which uses an improvement in the liquid crystal material which constitutes the liquid crystal layer of the liquid crystal display panel (also referred to as a liquid crystal cell), an improvement of the display mode, and the use of a direct backlight as a light source has been reported in Japanese Unexamined Patent Publication Hei11(1999)-109921. In a hold-type display device which uses a so-called direct backlight, in which a light source is directly mounted on a back surface of the liquid crystal display panel, has been proposed to use an illumination method which is referred to as blinking of the backlight. Here, a plurality of linear lamps (cold cathode fluorescent lamps or the like), or a light emitting diode array, are arranged in a direction parallel to gate lines right below a main surface (back surface) of the liquid crystal display panel, and the timings of respective lighting start times of the linear lamps are shifted from above to below on a display screen and are synchronized with the scanning cycles of the image display signals.

Further, Japanese Unexamined Patent Publication 2001-343949 discloses an attempt to widen the dynamic range of a display by inserting white signals or black signals between gray scale displays of respective colors in a projection type image display device.

The above-mentioned liquid crystal display device employs a method which controls the lighting time of the light source, in other words, inserts black images (also referred to as black signals) between the frames, and so the liquid crystal display device can enhance the motion picture display characteristics by obviating the generation of the motion picture profile deterioration to some extent. However, as a result, the light emission time which occurs during one period of the scanning becomes short; and, hence, the luminance efficiency of the illumination light is lowered, whereby a sufficient luminance cannot be obtained, and the whole image is darkened in proportion to the insertion ratio of the black image.

Accordingly, it is an object of the present invention to obtain a motion picture display of high luminance and high quality by eliminating the occurrence of motion picture profile deterioration at the time of displaying the motion picture on a hold-type display device by processing of video signals.

To achieve the above-mentioned object, in a driving method of the present invention, video data of a plurality of continuous frames, which are continuously inputted from an external signal source, are respectively stored in a plurality of frame memories, the video data which is stored in the first frame memory is read out in response to a 2 m (m being an integer of 1 or more) multiplied-speed clock signal which is obtained by multiplying a pixel clock signal inputted from an external signal source 2 m times, thus forming display data in a first field, and the video signals of two continuous frames are compared in accordance with every pixel display unit, wherein, when the pixel display unit of the succeeding frame has a higher luminance than the pixel display unit of the preceding frame, first display data is supplied to a display part as display data of a second field, and, when the pixel display unit of the succeeding frame has a lower luminance than the pixel display unit of the preceding frame, second display data is supplied to the display part as display data of the second field.

Further, in the same manner as described above, the video data which is stored in the first frame memory is read out in response to the 2 m multiplied-speed clock signal thus forming the display data in the first field; wherein, when the pixel display unit of the succeeding frame has a luminance which is higher than a given value, the first display data is supplied to the display part as the display data of the second field, and, when the pixel display unit of the succeeding frame has a luminance which is lower than a given value, the second display data is supplied to the display part as the display data of the second field.

Further, according to one aspect of the present invention, a display control circuit CRL is provided with a frame memory having two or more frames (or a memory having capacitance of two or more frames) and a clock synthesizer which multiplies the frequency of an input clock signal that is inputted from the external signal source (host computer) by twice (or twice and four times). For example, input video data (first n-frame data) inputted from the host computer is stored in one of the frame memories as first video data in response to a clock signal inputted from the host computer in the same manner; and, thereafter, the next inputted video data (the (n+1)th frame data) is stored in another frame memory as second video data. The first video data is read out as the display signal of the first field in response to a clock (double-speed clock) signal having a frequency twice as large as the frequency of the input clock signal, and it is supplied to respective drain drivers. Outputting to the respective drain drivers also makes use of the double-speed clock signal.

Next, the second video data which is stored in the frame memory is compared with the first video data in accordance with each pixel display unit; wherein, when the second video data is brighter than the first video data, the first display data is supplied to respective drain drivers as the display data of the second field, while, when the second video data is darker than the first video data, the second display data is supplied to respective drain drivers as the display data of the second field. When the second video data and the first video data have the same luminance, or there is no noticeable change between both video data, either one of the first display data or the second display data is selected in accordance with the contents (bright or dark) of the second video data and is supplied to the respective drain drivers as the display data of the second field. Here, one example of a turning point of the selection of the first black display data or the second white display data is that the luminance of the second video data is ½ the luminance of the black display and the white display.

Here, in place of the clock synthesizer, means which generates a clock signal which multiplies the frequency four times (or twice and four times) or more (eight times) may be provided separately. Further, after comparing the first video data (n frame) and the second video data ((n+1) frame), in place of setting the above-mentioned black display data or the white display data as the display data of the second field, the second video data is compared with a given value (a reference value). Then, it is possible that, when the second video data is brighter (the luminance is higher or the gray scale is higher) than the reference value, the first display data is used as the display data of the second field, and, when the second video data is darker (the luminance is lower or the gray scale is lower) than the reference value, the second display data is used as the display data of the second field. The given value can be arbitrarily set.

Further, it may be possible to adopt a method in which gray scale data amounting to $\pm\alpha$ ($\alpha$ being an arbitrary number) is added to the above-mentioned comparison result of the first video data and the second video data. The determination to set the gray scale data amounting to $\alpha$ to "+" or "−" is made in accordance with the degree of comparison with the first video data. This operation is a so-called overdrive operation.

Further, it also may be possible to provide a constitution which determines whether the display data of the second field should be the first display data or the second display data based on only the value of the second video data, without depending on the above-mentioned comparison result of the second video data and the first video data. Further, the above-mentioned respective processing may be performed for respective pixels or respective colors of red(R), green (G) and blue (B) individually. That is, when one pixel which is constituted of a dot displaying red, a dot displaying green and a dot displaying blue is set as a display unit, the above-mentioned first display data constitute data displaying white and the above-mentioned second display data constitute data displaying black. Further, when the respective three dots which constitute one pixel are set as single display units, respectively, with respect to the dot displaying red, the above-mentioned first display data constitute data displaying red. In the same manner, with respect to the dot displaying green, the above-mentioned first display data constitute data displaying green, and, with respect to the dot displaying blue, the above-mentioned first display data constitute data displaying blue. Here, in the above-mentioned respective dots, the second display data is data displaying black.

In this manner, by adopting the method in which one frame which is displayed on the display device is constituted of two fields, wherein, in the first field, video signals constitute the display data and, in the second field, the first display data or the second display data corresponding to contents of the next-input video signal constitute the display data, or either one of the first display data or the second display data constitute the display data as a result of comparison between the next-input video signal and the given value, or an arbitrary gray scale value is added to or is subtracted from a result of comparison between the next-input video signal and a given value so as to form the display data of the second field, it is possible to realize a video display of high luminance and high quality, in which it is possible to prevent the generation of motion picture profile deterioration, that is, so-called "motion picture blurring", without degrading the luminance of the display screen.

Here, the present invention is not limited to the above-mentioned constitution and the constitution disclosed in the embodiment described later, and various modifications can be made without departing from the technical concept of the present invention.

BRIEF DESCRIPTION OF THE DRAWINGS

FIG. 10A to FIG. 10D are diagrams which illustrate the concept involved in the generation of motion picture profile deterioration when a motion picture is displayed using a display device having holding characteristics, such as a liquid crystal display device or the like;

DESCRIPTION OF THE PREFERRED EMBODIMENTS

Figure 1:
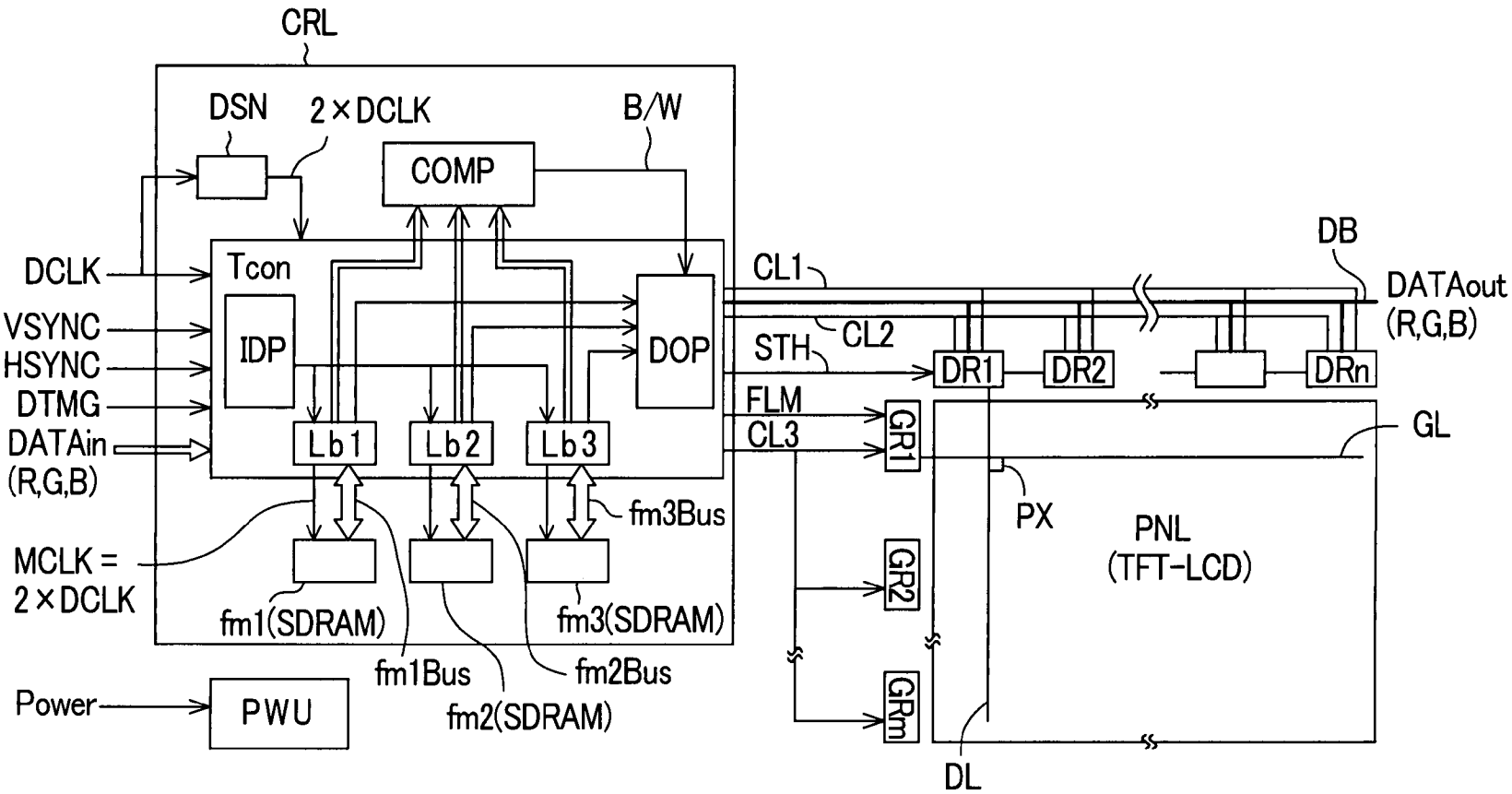
FIG. 1 is a block diagram showing the whole constitution of a display device for representing a first embodiment of the present invention.

Preferred embodiments of a liquid crystal display device according to the present invention will be explained hereinafter in detail in conjunction with the drawings. FIG. 1 shows the overall constitution of a display device representing a first embodiment of the present invention, and it is directed to an example in which the present invention is applied to a liquid crystal display device. The liquid crystal display device of this embodiment is constituted of a liquid crystal display panel PNL, a display control circuit CRL and a power source circuit PWU, and it has the following constitution.

In FIG. 1, the liquid crystal display panel PNL is formed of a thin-film-transistor type liquid crystal display panel TFT-LCD, wherein a plurality of drain drivers DR1, DR2, . . . DRn are arranged on one of the peripheries (or two parallel peripheries) thereof and a plurality of gate drivers GR1, GR2, . . . GRn are arranged on one of the other peripheries (or two parallel peripheries) disposed close to the side on which the drain drivers are arranged.

Respective gate drivers are connected with the gate lines GL for supplying scanning signals, and respective drain drivers are connected with the drain lines DL for supplying display signals. On respective crossing portions-of the drain lines DL and the gate lines GL of the liquid crystal display panel PNL, pixels PX, which are constituted of a thin film transistor circuit, are formed. Although the constitution is not illustrated in detail in the drawing, each pixel PX is constituted of a dot which displays red, a dot which displays green and a dot which displays blue. Here, a pixel is shown as being connected to one drain line in the drawing, the above-mentioned three dots are arranged close to each other along one gate line and respective dots are connected with respective drain lines. However, the arrangement of the respective dots is arbitrary, and there arises no problem even when the arrangement of the respective dots adopts a constitution in which respective dots are arranged at respective peaks of a triangle, thus constituting a so-called delta arrangement.

The display control circuit CRL is connected to the liquid crystal display panel PNL (TFT-LCD). The display control circuit CRL includes a timing controller Tcon which generates various timing signals for display, such as the above-mentioned clock signals. Further, the timing controller Tcon includes an input data processing circuit IDP and an output data processing circuit DOP, and these circuits generate input display data DATAin and data for display (output data DATAout) based on various timing signals. In this embodiment, the timing controller Tcon is provided with three line buffers Lb1, Lb2, Lb3.

The display control circuit CRL includes a double-speed clock synthesizer DSN, which generates a double-speed clock 2×DCLK by multiplying the frequency of a clock signal DCLK inputted from a host computer, and three frame memories fm1, fm2, fm3. The line buffers Lb1, Lb2, Lb3 temporarily hold display data for one line (display data for one scanning line), which is processed by the input data processing circuit IDP, and the display data are respectively transmitted to the frame memories fm1, fm2, fm3 through frame memory buses fm1Bus, fm2Bus, fm3Bus. A memory clock MCLK (=2×DCLK) is supplied to the line buffers Lb1, Lb2, Lb3 and the frame memories fm1, fm2, fm3 from the input data processing circuit IDP.

To the display control circuit CRL, the input display data DATAin (R, G, B), the dot clock signal DCLK, the vertical synchronizing signal VSYNC, the horizontal synchronizing signal HSYNC, and the display timing signal DTMG are inputted from the host computer. Further, clock signals CL1, CL2, CL3, a frame start signal FLM and a line start signal STH are outputted to the liquid crystal display panel TFT-LCD from the display control circuit CRL. Then, the display data is transferred to the liquid crystal display panel in accordance with a frame unit. Hereinafter, an explanation will be made with respect to a case in which one frame amount is constituted of two fields (a first field and a second field).

Figure 2:
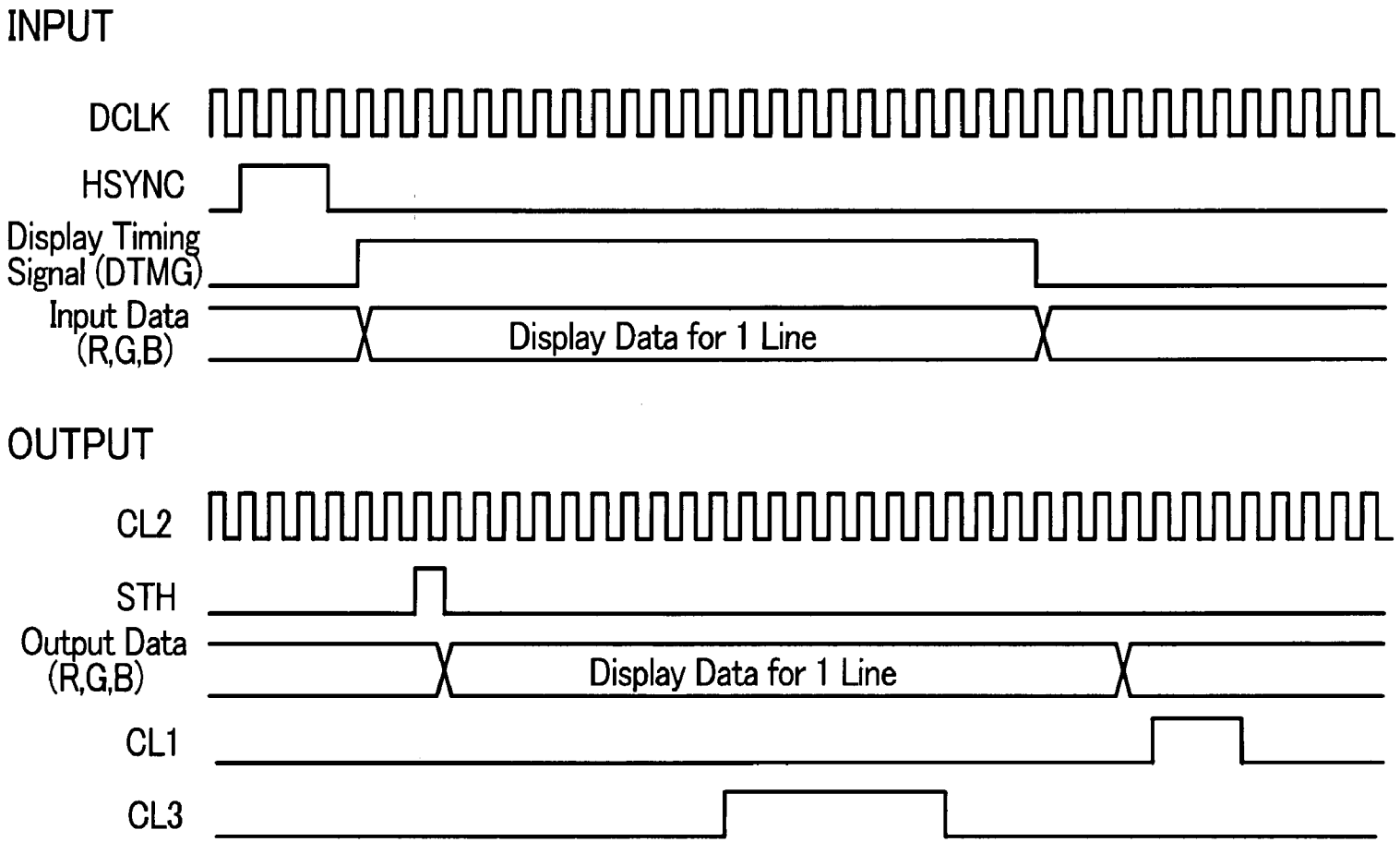
FIG. 2 is a basic timing chart of the horizontal operation timing in the driving method of an active matrix type liquid crystal display device.
Figure 3:
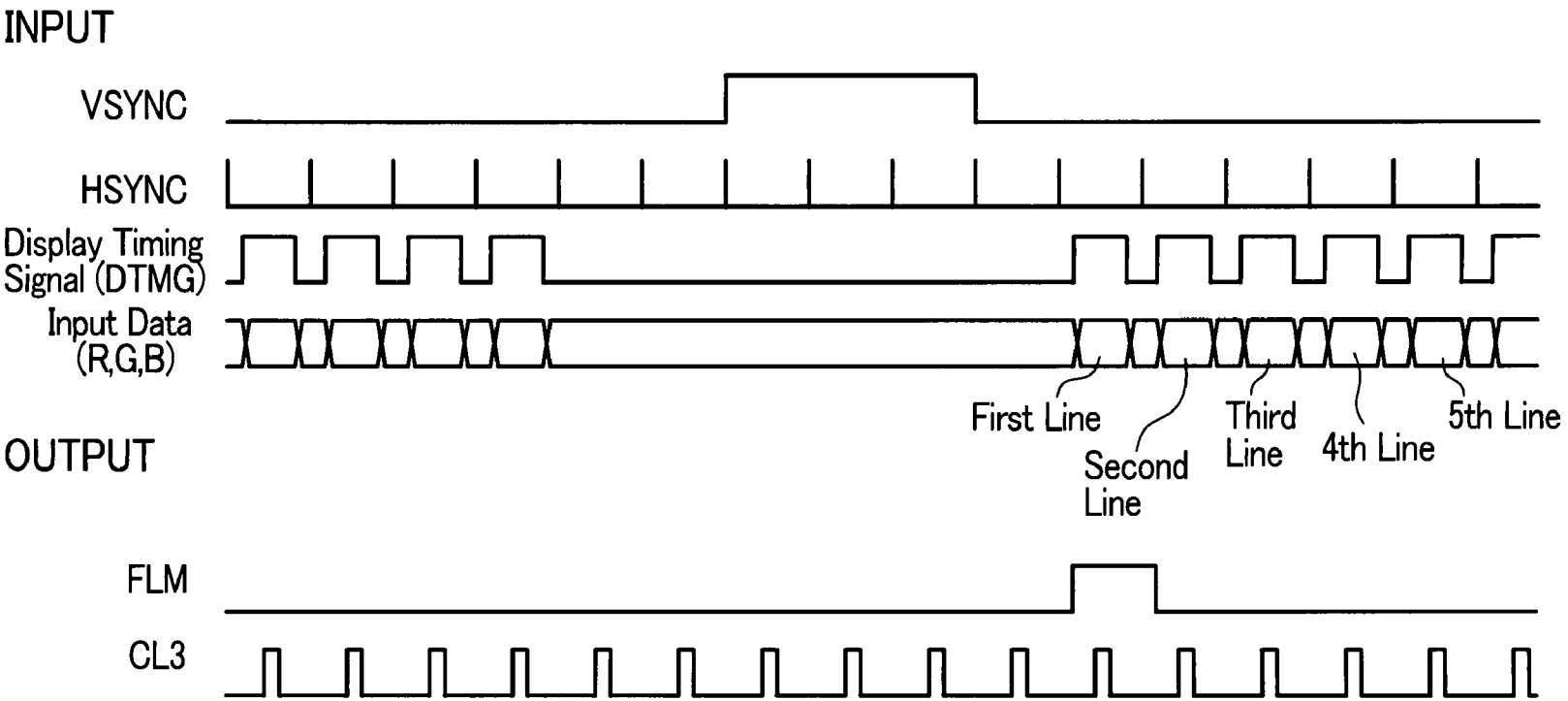
FIG. 3 is a basic timing chart of the vertical operation timing in the driving method of the active matrix type liquid crystal display device.
Figure 4:
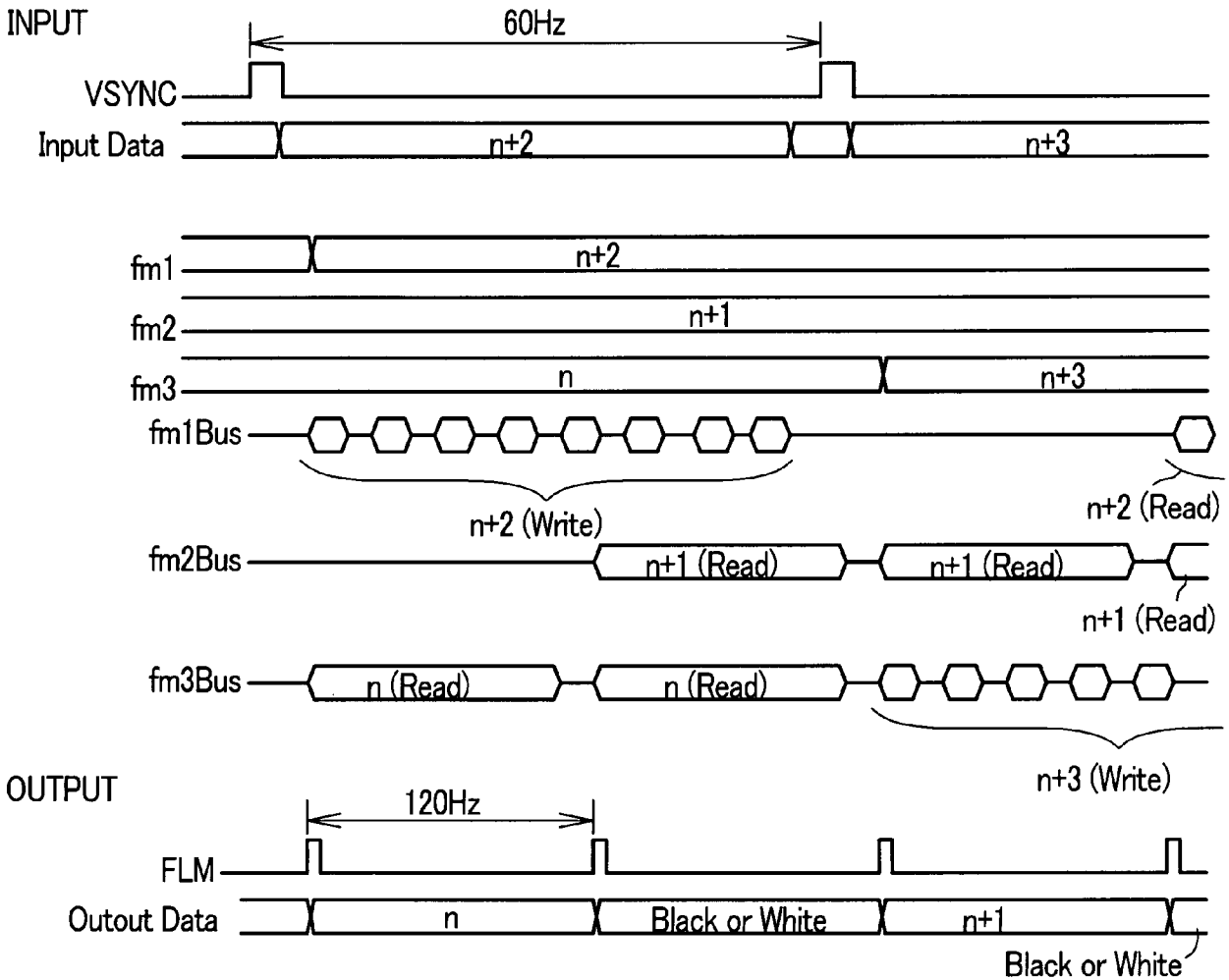
FIG. 4 is a timing chart for a driving method of the first embodiment of the present invention.

Further, FIG. 2 and FIG. 3 are basic timing charts which illustrate the driving method of the active-matrix-type liquid crystal display device, wherein FIG. 2 shows the operation timing in the horizontal direction and FIG. 3 shows the operation timing in the vertical direction. Further, FIG. 4 is a timing chart relating to the driving method of the first embodiment of the present invention. The driving method of this embodiment, as shown in FIG. 1, will be explained in conjunction with FIG. 2, FIG. 3 and FIG. 4. The explanation made hereinafter is an operational explanation using the timing controller Tcon as a reference.

The (INPUT) signals shown in FIG. 2 represent various signals for the horizontal-direction operations which are inputted to the timing controller Tcon from the host computer, and the OUTPUT signals shown in FIG. 2 represent various signals for the horizontal-direction operations which are outputted to the liquid crystal display panel from the timing controller Tcon. Further, the INPUT signals shown in FIG. 3 represent various signals for the vertical-direction operations which are inputted to the timing controller Tcon from the host computer, and the OUTPUT signals shown in FIG. 3 represent various signals for the vertical-direction operations which are outputted to the liquid crystal display panel from the timing controller Tcon.

In FIG. 2 and FIG. 3, the clock DCLK represent a dot clock signal (a pixel clock signal), HSYNC indicates the horizontal synchronizing signal, CL2 indicates a clock signal (=DCLK) written in the drain driver, and CL3 indicates a gate-driver shift clock signal. This operational timing is the basic operational timing employed in connection with the liquid crystal display device shown in FIG. 1. In the horizontal-direction operation, the timing controller Tcon outputs the clock signals CL1, CL2, CL3, the line start signal STH and the output display data DATAout to the liquid crystal display panel in response to the clock signal DCLK, the horizontal synchronizing signal HSYNC, the display timing signal DTMG and the input display data DATAin.

In the same manner, in the vertical-direction operation, the timing controller Tcon outputs the vertical synchronizing signal VSYNC, the horizontal synchronizing signal HSYNC, the display timing signal DTMG, the input display data DATAin, the frame pulse FLM, and the clock signal CL3 to the liquid crystal display panel. Here, one frame is 60 Hz, and, hence, one field becomes 120 Hz.

In this embodiment, as shown in FIG. 4, the timing controller Tcon includes three frame memories fm1, fm2, fm3, and the input display data DATAin are sequentially stored in the frame memories fm1, fm2, fm3 through given processing in the input data processing circuit IDP. The storing (writing) time of the input display data DATAin for one time/one pixel into the frame memories is equal to the frequency of the clock signal of the input display data DATAin. As a premise of the explanation made hereinafter, it is assumed that display data (video data) of the (n+1)th frame is stored in the frame memory fm2 and the display data of the nth frame is stored in the frame memory fm3. Accordingly, the display data of the (n+2)th frame is stored in the frame memory fm1 at this time.

Simultaneously with the above-mentioned timing, the display data stored in the frame memory fm3 (display data of the nth frame) is read out using the clock signal (double-speed clock signal) 2×DCLK having a frequency twice as large as the frequency of the clock signal DCLK of the input display data generated by the double-speed clock synthesizer DSN as the reference (for one pixel) read-out timing. The read-out display data of the nth frame becomes the display data of the first field. Since the display data is read out using the double-speed clock signal, all of the display data for the first field (120 Hz) stored in the frame memory fm3 is read out, given processing is applied to the display data in the output data processing circuit DPO, and the display data is outputted (transferred) to the drain driver DR of the liquid crystal display panel TFT-LCD, and video information is displayed on the screen. Subsequently, the display operation on the second field is performed.

In the display operation for the second field, the display data (the display data of the nth frame and the display data of the (n+1)th frame) which is stored in the frame memory fm3 and the frame memory fm2 are simultaneously read out in response to the double-speed clock signal 2×DCLK. Here, the display data stored in the frame memory fm2 is set as the comparison reference data, and the display data stored in the frame memory fm3 is set as the comparison data. The contents of the display data (one pixel unit) stored in the frame memory fm2, which constitute the comparison reference data, is compared with the display data stored in the frame memory fm3.

When the display data stored in the frame memory fm2 is display data which is darker than the display data stored in the frame memory fm3, the black display data is, as the display data of the pixel address corresponding to the black display data, is transmitted to the drain driver of the liquid crystal display panel through the output data processing circuit DOP. Further, when the display data stored in the frame memory fm2 is display data which is brighter than the display data stored in the frame memory fm3, the white display data are, as the display data of the pixel address corresponding to the white display data, is transmitted to the drain driver of the liquid crystal display panel. This processing is executed with respect to all display pixels (for one screen) of the liquid crystal display panel. Since the operations (reading out of display data from the frame memories and display data transfer processing to respective drain drivers) on the second field are also executed using the double-speed clock signal as a reference, the processing of the black display/white display is completed within the second field.

In inputting the next video frame ((n+3) frame), the input display data is stored in the frame memory fm3, wherein the frame memory fm2 provides the display data of the first field and the comparison data in the second field, while the display data stored in the frame memory fm1 becomes the comparison reference data in the second field. In the same manner as the above-mentioned operations, the video data is displayed on the first field, and the black display data or the white display data is displayed in the second field. This processing is repeated.

In the actual circuit constitution, a SDRAM or a DRAM capable of responding to a DDR can be adopted as the frame memories fm1 to fm3. In this case, the reference clock signal (also referred to as the memory clock signal) is also transmitted to the SDRAM. Accordingly, the double-speed frequency clock signal is used also in the writing (storing) processing. It is not usually conceivable to change the frequency of the memory clock signal for every processing. Accordingly, in the writing processing, the display data is temporarily held in the line buffers Lb1, Lb2, Lb3 in the inside of the timing controller Tcon; and, thereafter, the access (the writing processing, the storage processing) to the frame memories is performed. The reading processing may be performed through the line buffers Lb1, Lb2, Lb3.

Accordingly to this embodiment, the motion picture profile deterioration which is generated at the time of displaying the motion picture on the typical holding-type liquid crystal display device can be eliminated, whereby it is possible to provide a motion picture display of high luminance and the high quality.

Figure 5:
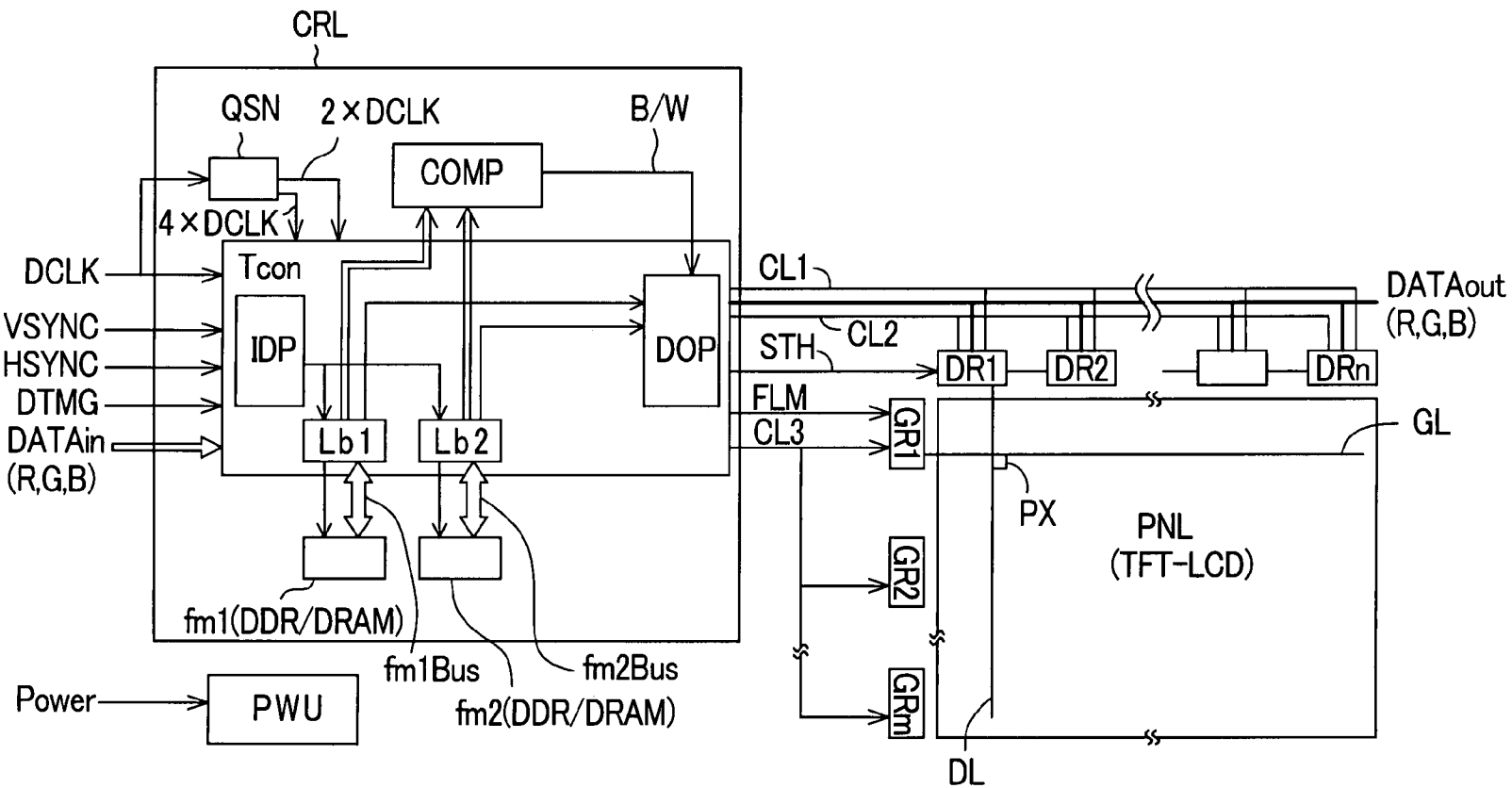
FIG. 5 is a block diagram showing the whole constitution of the display device according to a second embodiment of the present invention.

FIG. 5 shows the overall constitution of a display device according to a second embodiment of the present invention, and it is directed to an example in which the present invention is applied to a liquid crystal display device in the same manner as the first embodiment. The liquid crystal display device of this embodiment is also constituted of a liquid crystal display panel PNL, a display control circuit CRL and a power source circuit PWU. In this embodiment, two line buffers Lb1, Lb2 are provided in the inside of a timing controller Tcon. Further, the display control circuit CRL includes two frame memories fm1, fm2 and a fourfold speed clock synthesizer QSN.

The fourfold speed clock synthesizer QSN generates a fourfold speed clock signal 4×DCLK and a double speed clock signal 2×DCLK from the clock signals DCLK. Further, a DRAM capable of responding to a DDR is used at frame memories fm1, fm2, thus providing a constitution which enables rapid access using the fourfold clock signal. Here, the double speed clock signal 2×DCLK becomes an output reference clock for the drain drivers. Since this embodiment is equal to the first embodiment shown in FIG. 1 with respect to the other features thereof, a repeated explanation is omitted.

Figure 6:
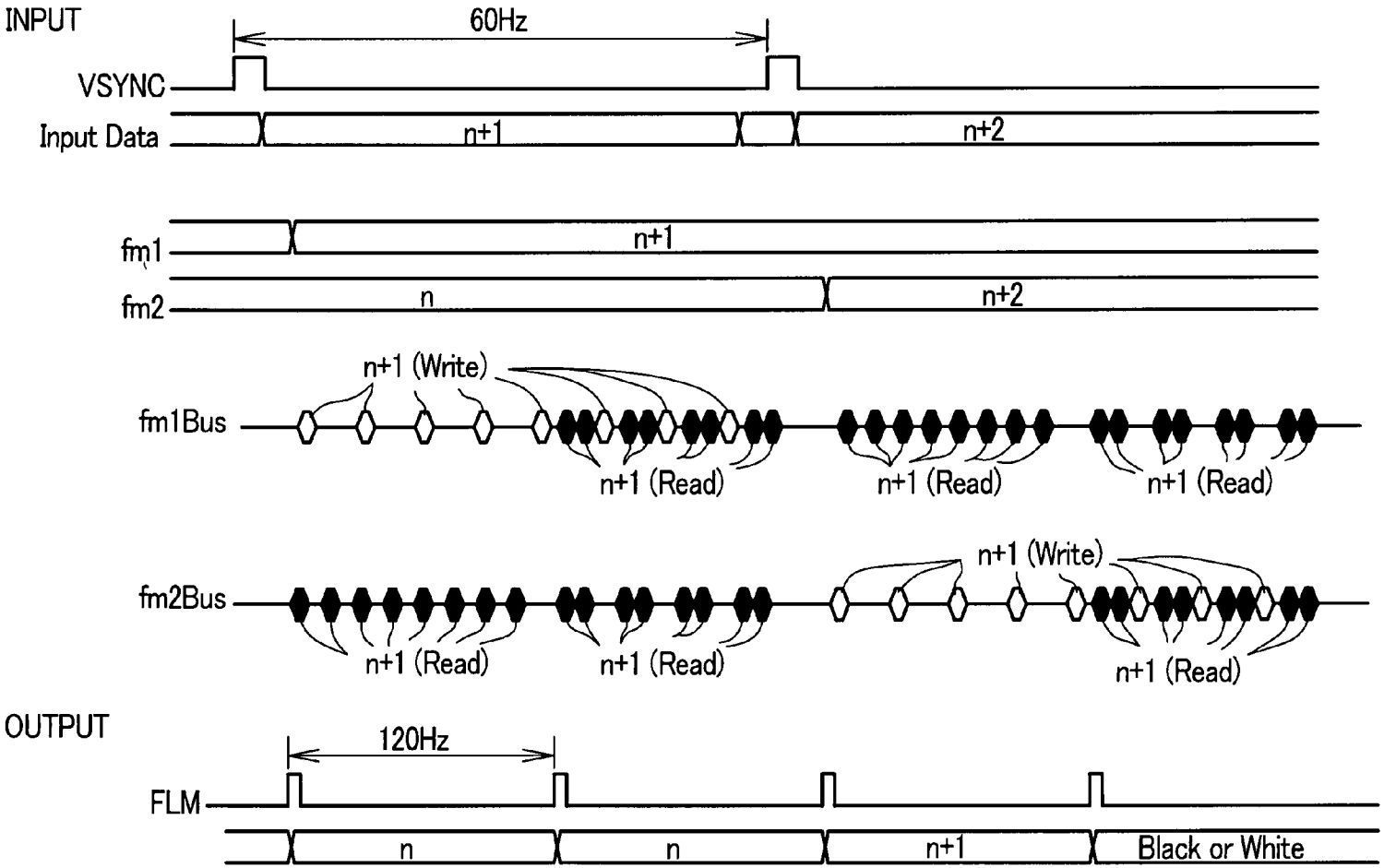
FIG. 6 is a timing chart for the driving method of a second embodiment of the present invention.

FIG. 6 is a timing chart which illustrates the driving method of the second embodiment of the present invention. In the drawing, the INPUT symbols are various signals for the horizontal-direction operations which are inputted to the timing controller Tcon from the host computer, the INSIDE symbols are various signals relevant to internal signal processing in the timing controller Tcon, and the OUTPUT symbols are various signals for the horizontal-direction operations which are outputted to the liquid crystal display panel from the timing controller Tcon. The operation of the display device shown in FIG. 5 will be explained in conjunction with the timing chart shown in FIG. 6. The input display data DATAin transmitted from the host computer is subjected to given processing in an input data processing circuit IDP and is sequentially stored in frame memories fm2, fm1 via the line buffers Lb2, Lb1. As a premise at this stage of processing, it is assumed that the nth-frame video data (display data) is stored in the frame memory fm2. Accordingly, the (n+1)th video data (display data) is stored in the frame memory fm1. Here, the line buffers and the frame memory are connected by memory buses fm1Bus and fm2Bus.

Simultaneously with this timing, the data stored in the frame memory fm2 IS read out using the fourfold speed clock signal 4×DCLK, and the data is temporarily held in the line buffer Lb2. The data which is temporarily held in the line buffer Lb2 becomes display data of the first field. The data which is temporarily held in the line buffer Lb2 is read out using the double speed clock signal 2×DCLK and is transferred to drain drivers of the liquid crystal display panel through an output processing circuit DOP. All display data for the first field (corresponding to 120 Hz) that is stored in the frame memory fm2 is read out and displayed on a liquid crystal display panel. Subsequently, the operation of the second field is executed.

In the operation of the second field, the data stored in the frame memories fm2, fm1 are simultaneously read out using the fourfold speed clock signal 4×DCLK. Here, the display data stored in the frame memory fm1 becomes the comparison reference data and the display data stored in the frame memory fm2 becomes the comparison data. The contents (one pixel unit) of the display data stored in the frame memory fm1 and the contents (one pixel unit, same in-screen display address) of the display data stored in the frame memory fm2 are compared with each other. When the display data stored in the frame memory fm1 is darker than the display data stored in the frame memory fm2, black display data is transferred to the drain drivers through the output processing circuit DOP as display data of an address corresponding to the black display data. On the other hand, when the display data stored in the frame memory fm1 is brighter than the display data stored in the frame memory fm2, white display data is transferred to the drain drivers through the output processing circuit DOP as display data of an address corresponding to the white display data.

This processing is executed with respect to all display pixels (for one screen) of the liquid crystal display panel. Since the operations (reading out of display data from frame memories and display data transfer processing to respective drain drivers) on the second field are also executed using the double-speed clock signal as a reference, the processing of the black display/white display is completed within the second field. In the next video frame ((n+2) frame) inputting, the display data of the (n+2) frame is stored in the frame memory fm2, wherein the data stored in the frame memory fm1 provides the display data of the first field and the comparison data in the second field, while the display data stored in the frame memory fm2 becomes the comparison reference data in the second field. Hereinafter, this processing is repeated.

Also, in this embodiment, the motion picture profile deterioration, which is generated at the time of displaying a motion picture on the typical holding-type liquid crystal display device, can be eliminated, whereby it is possible to provide a motion picture display of high luminance and high quality.

Here, in the above-mentioned respective embodiments, the storage capacitance of one frame memory is set to correspond to one frame. However, with the use of a high speed memory, such as a DDR, it is possible to constitute a memory corresponding to a plurality of frames using a single large-capacity, memory and it is also possible to execute processing using a high speed clock signal frequency, for example, an eightfold speed clock signal frequency. In this case, a constitution is provided which replaces the frame memories fm1 to fm3 shown in FIG. 1 or the frame memories fm1, fm2 shown in FIG. 5 with one large capacitance memory.

Figure 7:
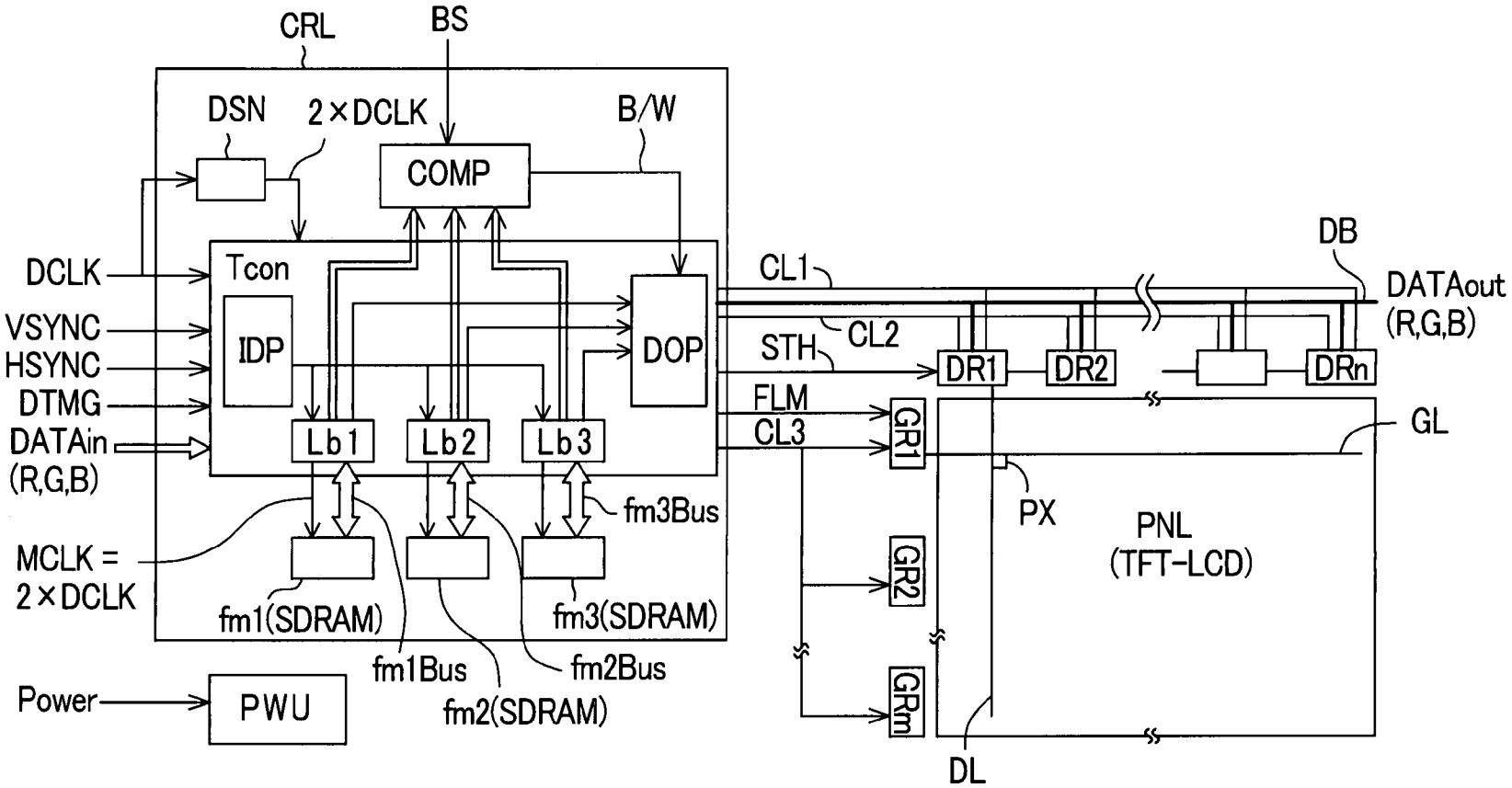
FIG. 7 is a block diagram showing the whole constitution of the display device according to a third embodiment of the present invention.

FIG. 7 is a block diagram showing the overall constitution of a display device according to a third embodiment of the present invention. The constitution shown in FIG. 7 is substantially equal to the constitution shown in FIG. 1 except for the function of the comparison circuit COMP, and, hence, repeated explanation thereof is omitted. In this embodiment, the video data of the nth frame stored in the frame memories fm1 to fm3 are supplied to the liquid crystal display panel as display data of the first field. Thereafter, the above-mentioned comparison circuit COMP in the first embodiment compares the brightness (luminance or gray scales) of the pixels of the (n+1)th frame stored in the frame memories fm1 to fm3 with a given value BS; and, when the comparison result is higher than the given value BS (brighter, high luminance, high gray scale), the display of the second field is performed as white display data, while, when the comparison result is lower than the given value BS (darker, low luminance, low gray scale), the display of the second field is performed as the display data. Although it is preferable to set the given value BS to ½ of the display ability (dynamic range) of the display device, the given value BS may be set to any other value as desired. Further, it may be possible to configure the device such that the given value BS can be arbitrarily set from the outside.

Further, as a fourth embodiment of the present invention, a given gray scale value may be added to or subtracted from a gray scale value of the pixel of the (n+1)th frame in response to the comparison result of the comparison circuit COMP shown in FIG. 7. In this case, it is also possible to arbitrarily set the gray scale value, which fluctuates slightly in the ±directions, as the given value BS.

Further, the embodiment shown in FIG. 7 and the embodiment shown in FIG. 4 may be applicable to the second embodiment which was described in conjunction with FIG. 5. Further, the above-mentioned embodiments are focused on one pixel which is constituted of a dot which displays red, a dot which displays green and a dot which displays blue; and, hence, the explanation is made with respect to a case in which the second field is displayed in the white display or the black display based on the given luminance. However, it is also possible to perform the displays with respect to the above-mentioned respective three dots based on the given luminance. That is, the red display or the black display is performed with respect to the dot which displays red, the green display or the black display is performed with respect to the dot which displays green, and the blue display or the black display is performed with respect to the dot which displays blue. Further, the white display or the red, green and blue displays indicated here are not limited to the maximum luminance which the respective pixels or dots can display and may be a luminance lower than the maximum brightness. In the same manner, the black display is not limited to the minimum luminance which the respective pixels or the dots can display and may be set to a luminance higher than the minimum luminance.

Figure 8:
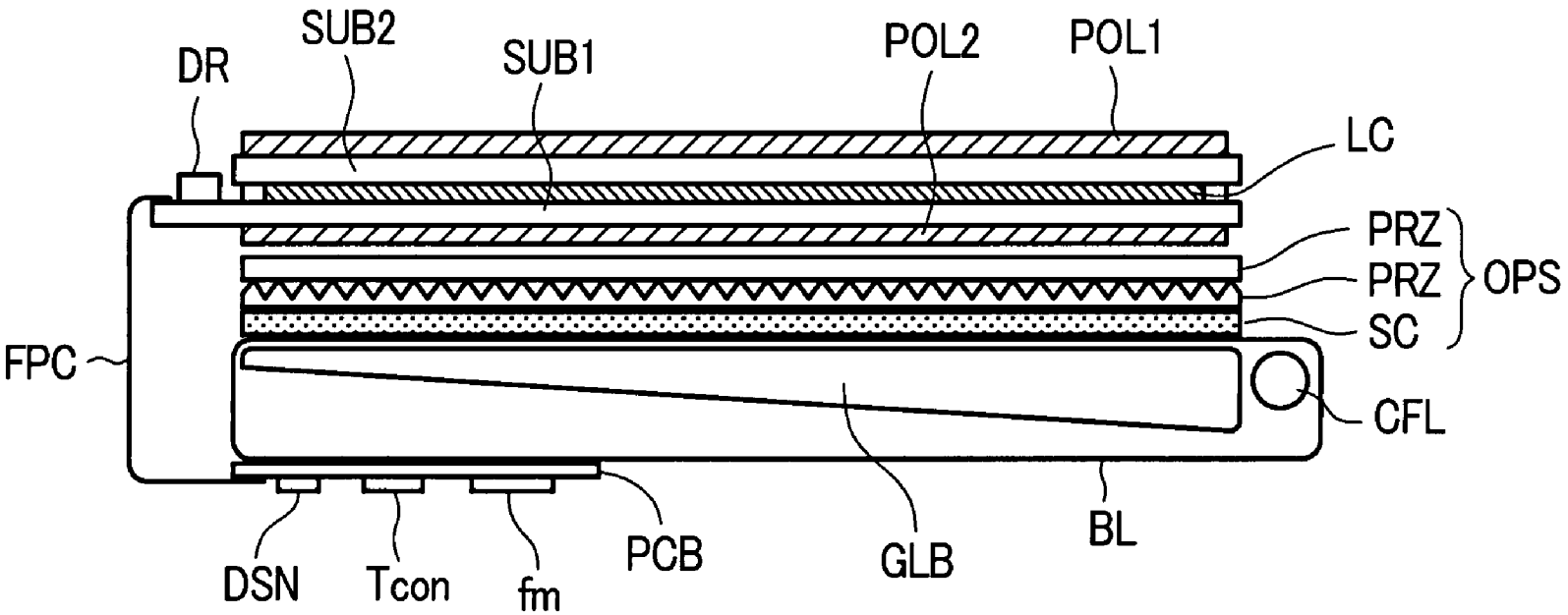
FIG. 8 is a diagrammatic cross-sectional view showing the constitution of a liquid crystal display device which represents one example of a display device to which the present invention is applied.
Figure 9:
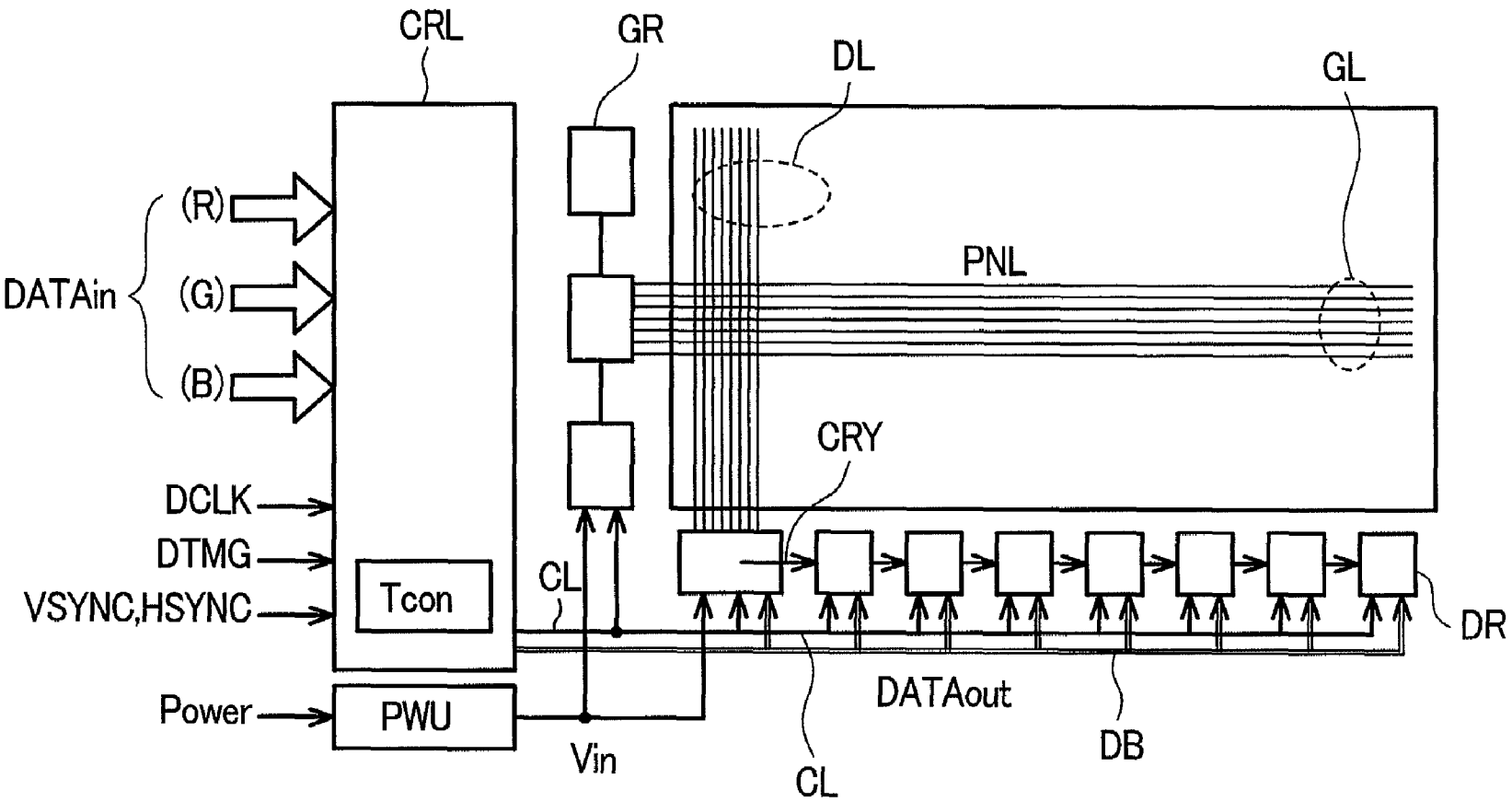
FIG. 9 (Prior Art)
FIG. 9 is a block diagram showing the constitution and a driving system of a general active-matrix type liquid crystal display device.
Figures 10A, 10B, 10C, 10D:
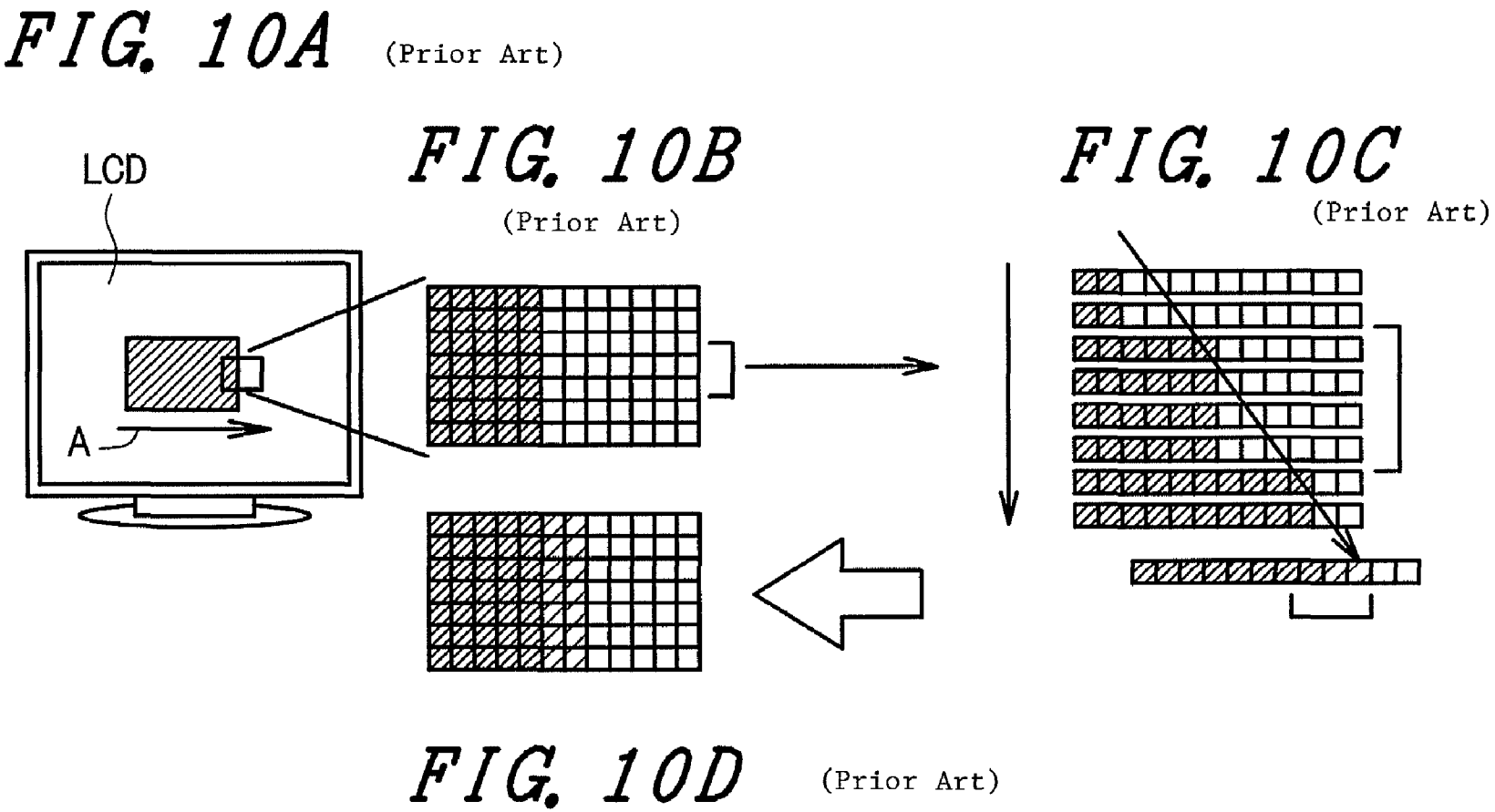
FIG. 10A (Prior Art)
FIG. 10B (Prior Art)
FIG. 10C (Prior Art)
FIG. 10D (Prior Art)

FIG. 8 is a cross-sectional view showing the constitution of the liquid crystal display device which constitutes one example of the display device to which the present invention is applied. The liquid crystal display device of this example is constituted of the liquid crystal display panel PNL in which a liquid crystal layer LC is sandwiched between a first substrate SUB1 and a second substrate SUB2, which are preferably made of glass, and a backlight BL is provided as a light source. The first substrate SUB1 is a so-called active substrate (also referred to as a thin film transistor substrate or a TFT substrate), and it forms drain lines, gate lines and pixels on an inner surface thereof and has a drain driver DR and a gate driver mounted on an outer side of a periphery thereof. Since the gate driver is mounted on the other side, the gate driver is not shown in the drawing. Polarizers POL1, POL2 are stacked on respective surfaces of the first substrate SUB1 and the second substrate SUB2. An optical sheet OPS is interposed between the liquid crystal display panel PNL and the backlight BL. Although the optical sheet OPS is configured such that a diffusion sheet SC and a prism sheet PRZ are laminated to each other, as shown in the drawing, the optical sheet OPS is not limited to such a configuration.

The backlight BL is of a so-called side edge type which is constituted of a light guide body GLB and a cold cathode fluorescent lamp CFL. On a back surface of the backlight BL, an interface printed circuit board PCB is mounted. On the interface printed circuit board PCB, the timing controller Tcon, the double speed clock synthesizer DSN (or fourfold speed clock synthesizer QSN), the frame memories fm (fm1 to fm3 or fm1 and fm2), have been discussed which in connection with the previously-described embodiments, are mounted, and these parts are connected with the drain driver DR and the gate driver GR (the gate driver GR not shown in the drawing) using a flexible printed circuit board FPC.

An explanation of the overdrive driving will be made hereinafter. The overdrive driving is driving in which the display data signal of one preceding frame and the present display data signal are compared to each other with respect to respective colors R, G, B, and the luminance data which exceeds a gray scale change quantity is inputted to a signal line driving circuit so as to increase the change quantity, whereby the response speed of the liquid crystal is enhanced.

Figure 11:
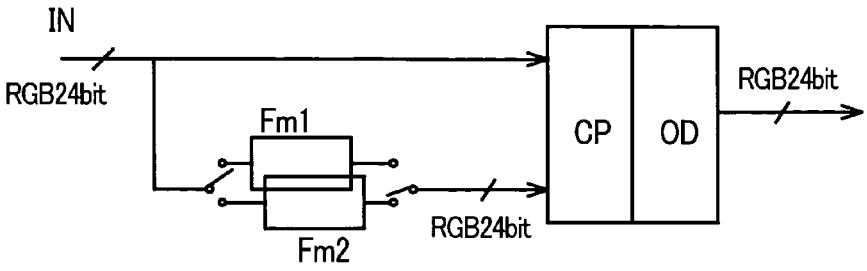
FIG. 11 is a circuit diagram showing an embodiment 4 of the present invention.

FIG. 11 relates to the fourth embodiment of the present invention, and it shows the constitution that is employed for performing the overdrive driving. From an image signal output device, such as a personal computer or the like, RGB data of 24 bits, for example, is supplied to the display device. This RGB data is data of one dot which displays R(red), G(green), B(blue), and each of the R, G, B data is constituted of 8 bits. Data which is supplied during a certain period is inputted to a comparator CP for overdrive driving and, at the same time, the data is also inputted to the first frame memory Fm1. Further, along with the above-mentioned operation, the data of one preceding frame, which is already stored in the second frame memory Fm2, is read out and supplied to the comparator CP, whereby the comparator CP compares the data which is supplied during the certain frame period and the data of one preceding frame. Further, based on the comparison result, an arithmetic operation part OD performs an overdrive arithmetic operation and the arithmetic operation result is outputted as data RGB of 24 bits. Here, the output data RGB of 24 bits is inputted into the display control circuit CRL shown in FIG. 1 or the like as the above-mentioned input display data DATAin. Further, in a frame which follows the above-mentioned frame, the display data supplied from the image signal output device is stored in the second frame memory and the display data of one preceding frame stored in the above-mentioned manner is supplied to the comparator CP. Thereafter, the above-mentioned steps are repeated so as to perform the processing for carrying out overdrive driving.

As the above-mentioned frame memory, a memory such as a DRAM having 32 bits has been generally used. Here, although the details of the inner structure of the above-mentioned comparator and the arithmetic operation part, the timing and the like are not described here, they are not specifically limited. The display data may be supplied from the image signal output device, such as a personal computer, for every one dot in series or for every two dots in parallel. Further, the display data may be supplied using differential signals for narrowing the width of the bus used for supplying the display data.

Figure 12:
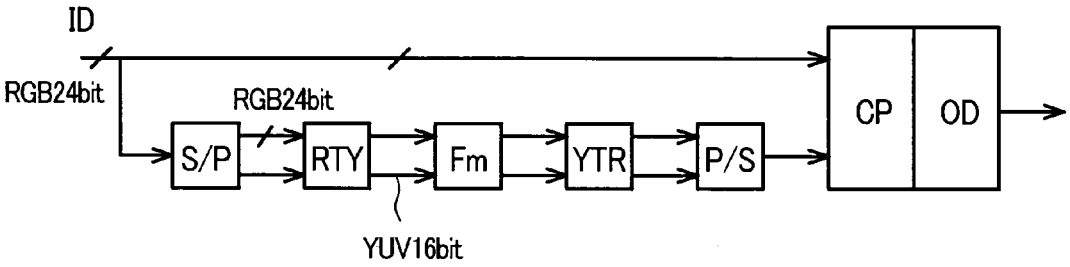
FIG. 12 is a circuit diagram showing an embodiment 5 of the present invention.

FIG. 12 relates to the fifth embodiment of the present invention, and it shows another constitution for performing the overdrive driving. In the same manner as the constitution shown in FIG. 11, the display data, consisting of RGB 24 bits of a certain frame, is supplied from an image data output device, such as a personal computer. The supplied display data is inputted to a comparator CP for overdrive driving, and, at the same time, it is inputted to a serial/parallel conversion circuit S/P. In the serial/parallel conversion circuit S/P, the display data, consisting of RGB 24 bits, which is inputted for every one bit in series, is outputted as parallel data of two dots. The output data is inputted-to a RGB-YUV conversion circuit RTY. In the RGB-YUV conversion circuit RTY, the signals inputted in a form of RGB data are converted into YUV data. The YUV data is display data consisting of a signal (Y), which indicates luminance, and signals (U, V), which indicate color difference. The RGB-YUV conversion circuit RTY, based on the RGB data for two dots that is inputted in parallel, obtains the luminance of respective dots and the color difference between two dots and outputs the obtained result as YUV data. At this point of time, the RGB-YUV conversion circuit RTY outputs two YUV data formed of 16 bits. The two YUV data formed of 16 bits that have been outputted from the RGB-YUV conversion circuit RTY are inputted and stored in a frame memory Fm.

Along with the above-mentioned operations, the YUV data relating to the one preceding frame, which is already stored in the frame memory, is read out. Two YUV 16-bit signals are read out in parallel from the frame memory and are supplied to a YUV-RGB conversion circuit YTR. In the YUV-RGB conversion circuit YTR, opposite to the previously-mentioned RGB-YUV conversion circuit RTY, two input YUV 16-bit data are converted into two RGB 24-bit data. Two converted RGB 24-bit data are inputted to a parallel/serial conversion circuit P/S and are converted into serial RGB 24-bit data for one dot; and, thereafter, serial RGB 24-bit data is inputted to the comparator CP. In the comparator CP, the inputted display data of the present frame and the display data of one preceding frame, which is read out from the frame memory, are compared. Then, the overdrive arithmetic operation is performed by an arithmetic operation part OD, and a result of the arithmetic operation is outputted as RGB 24-bit data. The outputted RGB 24-bit data is inputted to the display control circuit CRL shown in FIG. 1 and the like as the above-mentioned input display data DATAin. The manner of operation after the inputting of data to the comparator is substantially equal to the corresponding manner of operation described in connection with FIG. 11.

In the constitution shown in FIG. 12, two YUV 16-bit data are supplied to a frame memory having a 32-bit constitution. Accordingly, compared to the constitution shown in FIG. 11, the data for two dots can be collectively written in the frame memory or can be read out from the frame memory. That is, the writing of the data into the frame memory and the reading out of the data from the frame memory can be alternately performed by time division processing. Accordingly, although two frame memories are necessary in the constitution shown in FIG. 11, the constitution shown in FIG. 12 requires only one frame memory; and, hence, the utilization efficiency of the frame memory is enhanced, whereby a low-cost constitution can be realized. It is needless to say that by providing the parallel/serial conversion circuit between the RGB-YUV conversion circuit and the frame memory and, at the same time, by providing the serial/parallel conversion circuit between the frame memory and the YUV-RGB conversion circuit, it is possible to change over the constitution of the frame memory with two 16-bit constitutions from one 32-bit constitution. In this case, as shown in FIG. 11, although it is necessary to alternately operate two frame memories, compared to the case shown in FIG. 11, a reduction of the cost can be realized.

Further, when the image signal output device outputs the RGB data for two dots, by transferring the serial/parallel conversion circuit shown in FIG. 12 to a bus to which the display data of the present frame is directly supplied, it is possible to perform substantially the same processing.

Figure 13:
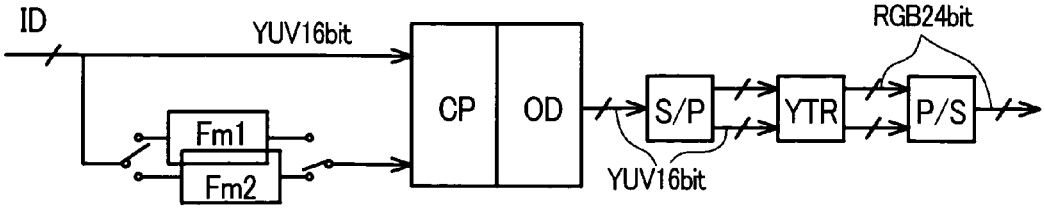
FIG. 13 is a circuit diagram showing an embodiment 6 of the present invention.

FIG. 13 shows a sixth embodiment of the present invention. In the above-mentioned embodiments, as the image signal output device, a device such as a personal computer which outputs display data consisting of RGB bits is assumed. However, a television set or the like directly outputs YUV data. That is, a television set or the like supplies YUV data of 16 bits that is outputted from the image signal output device to a comparator CP for performing the overdrive driving, and, at the same time, it supplies the data to a first frame memory Fm1 having a 16-bit constitution. Along with such an operation, the frame data of one preceding frame stored in a second frame memory Fm2 is read out from the second frame memory Fm2 and is supplied to the comparator CP. The comparator CP compares the present frame data and the frame data of one preceding frame. An arithmetic operation circuit OD performs overdrive processing based on a comparison result. The comparator CD and the arithmetic operation circuit OD, which are different from the comparator CD and the arithmetic operation circuit OD shown in FIG. 11 and FIG. 12, perform the processing based on the YUV data. Then, the arithmetic operation circuit OD outputs the result of the arithmetic operation as 16-bit YUV data. The outputted YUV data is converted into parallel data by a serial/parallel conversion circuit S/P, and the parallel data is inputted to a YUV-RGB conversion circuit YTR. The YUV-RGB conversion circuit YTR outputs the inputted data as RGB 24-bit data for two dots. Thereafter, as shown in FIG. 13, the RGB 24-bit data for two dots is inputted to a parallel/serial conversion circuit P/S and is outputted as serial data for every dot. Then, the serial data for every dot is inputted to the display control circuit CRL shown in FIG. 1 or the like as the input display data DATAin. However, there arises no problem in inputting the parallel data for two dots into the display control circuit CRL as the input display data DATAin. Usually, when the RGB data is converted into YUV data and, further, the YUV data is converted into RGB data, the original data and the data after inversion do not always agree with each other. However, in the constitution shown in FIG. 13, the inputted data per se is YUV data; and, hence, it is possible to exclude the disagreement of the base data, and the reproduced data and, at the same time, the overdrive driving focusing on the Y (luminance) information can be easily performed. Here, various methods have been known with respect to the conversion of RGB data into YUV data and the inversion of YUV data into RGB data and the use of the conversion/inversion referred to as YUV422 is assumed with respect to the above-mentioned constitution. However, the conversion and the inversion are not limited to specific methods. Further, as the conversion circuit, a method which realizes the conversion circuit by using a shift circuit (½n formation) and an addition circuit, a method which uses a DSP and the like are known. However, the conversion circuit may be suitably modified without departing from the gist of the present invention.

Figure 14:
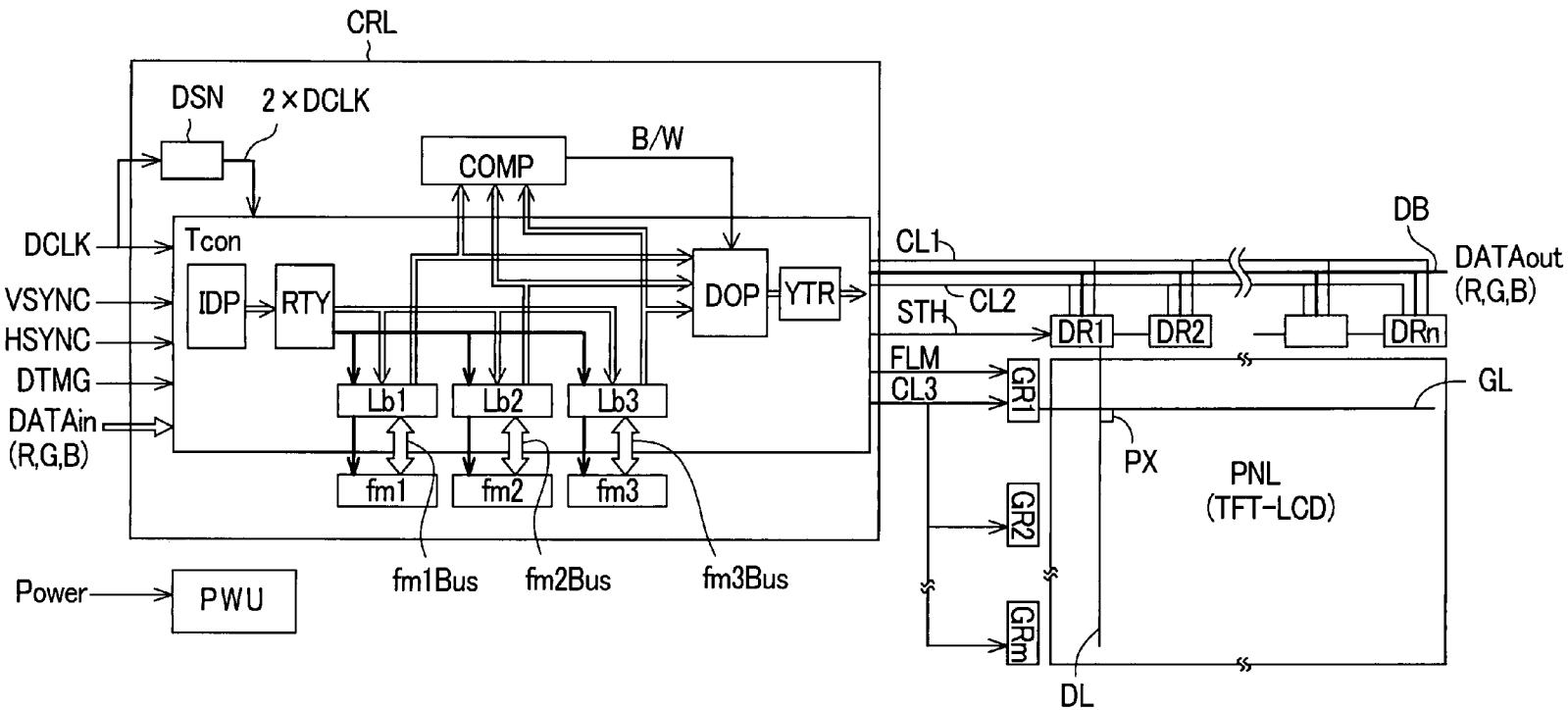
FIG. 14 is a block diagram showing the whole constitution of a display device representing an embodiment 7 of the present invention.

FIG. 14 relates to a seventh embodiment of the present invention, and it shows a constitution which applies the YUV conversion shown in FIG. 11 to FIG. 13 to the constitution shown in FIG. 1. The RGB 24-bit display data, which is supplied to a display control circuit CRL from the outside, is inputted to an input data processing circuit IDP, and, thereafter, it is supplied to line buffers via a RGB-YUV conversion circuit RTY. At this point of time, the RGB 24-bit display data is converted into 16-bit YUV data and is supplied to the line buffers. Although the data of the line buffers is stored in frame memories, as mentioned previously, it is possible to reduce the capacitance of the frame memories compared to the constitution shown in FIG. 1. Further, the YUV data which is read out from the frame memories is again fetched by the line buffers and is supplied to a comparison circuit COMP where the comparison shown in FIG. 1 is performed. Although the comparison per se is not different from the comparison performed in FIG. 1, since the same data, that is, the YUV data having a luminance signal and YUV data also having a luminance signal are compared, the processing is facilitated compared to the processing shown in FIG. 1. Further, although the YUV data of the line buffers is also supplied to an output data processing circuit DOP, a YUV-RGB conversion circuit YTG is provided in a rear stage of an output data processing circuit, and, hence, the RGB signals are supplied to the display panel. In the constitution shown in FIG. 14, at the time of performing the YUV-RGB conversion, it is necessary that the conversion is not performed with respect to the black data or the white data outputted from the output data processing circuit. However, it may be possible to adopt a constitution in which three YUV-RGB conversion circuits are provided between the respective line buffers and the comparison circuit and a comparison is performed using the RGB. Further, it may be possible to adopt a constitution in which three YUV-RGB conversion circuits are provided between the respective line buffers and the output data processing circuit.

Here, although not shown in the drawing, it is possible to apply the constitution shown in FIG. 14 to the constitution shown in FIG. 5 or FIG. 7. Further, when the signals inputted from the outside are YUV data, it is unnecessary to provide the RGB-YUV conversion circuit between the input data processing circuit and the line buffer, and it is sufficient to convert the YUV data into RGB data immediately before the display panel. On the other hand, it may be possible to adopt a constitution in which the YUV data is converted into RGB data at a stage before the comparison, and the comparison is performed using the RGB data. Whichever method is adopted, compared to the constitutions shown in FIG. 1, FIG. 5 and FIG. 7, it is possible to decrease the capacity of the frame memory, and, hence, a reduction of the cost can be realized.

By driving the liquid crystal display device using the method explained in connection with each embodiment, it is possible to realize a motion picture display of high luminance and high quality at a low cost without generating the motion picture profile deterioration.

Although an explanation has been made with respect to the example in which the above-mentioned liquid crystal display device adopts a side-edge type backlight, the present invention is not limited to such a liquid crystal display device, and the present invention is applicable to a liquid crystal display device with a so-called direct backlight in which a plurality of linear light sources are arranged on a back surface of the liquid crystal display panel. Further, the present invention is not limited to a liquid crystal display device, but is applicable to any display device provided that the display device is a hold-type display device.

As has been explained heretofore, according to the present invention, it is possible to enhance the motion picture display characteristics by obviating the generation of the motion picture profile deterioration particularly in a motion picture display in which a video moves, whereby it is possible to provide a display device of high quality and high luminance.

What is claimed is:

1. A driving method of a display device having a screen thereof for one frame constituted of a first field and a second field, wherein video data of a plurality of continuous frames which are continuously inputted from an external signal source are respectively stored in a plurality of frame memories, the video data which are stored in the first frame memory are read out in response to a 2 m (m being an integer of 1 or more) multiplied-speed clock signal which is obtained by multiplying a pixel clock signal inputted from an external signal source 2 m times thus forming display data in a first field, and the video signals of two continuous frames are compared in accordance with every pixel display unit, wherein when the pixel display unit of the succeeding frame has the higher luminance than the pixel display unit of the preceding frame, first display data are supplied to a display part as display data of a second field and when the pixel display unit of the succeeding frame has the lower luminance than the pixel display unit of the preceding frame, second display data are supplied to the display part as display data of the second field, wherein the display unit indicates a dot which displays red possessed by the pixel, a dot which displays green possessed by the pixel and a dot which displays blue possessed by the pixel respectively, the first display data are data which display respective colors which the respective dots display, and the second display data are data which display black.

2. A driving method of a display device having a screen thereof for one frame constituted of a first field and a second field, wherein video data of a plurality of continuous frames which are continuously inputted from an external signal source are respectively stored in a plurality of frame memories, the video data which are stored in the first frame memory are read out in response to a 2 m (m being an integer of 1 or more) multiplied-speed clock signal which is obtained by multiplying a pixel clock signal inputted from an external signal source 2 m times thus forming display data in a first field, and when the pixel display unit of the succeeding frame has the luminance higher than a given value, the first display data are supplied to the display part as the display data of the second field and when the pixel display unit of the succeeding frame has the luminance lower than a given value, the second display data are supplied to the display part as the display data of the second field, wherein the multiplying number 2 m is 4 and two frame memories are provided each of which stores the video signal for one frame.

3. A display device comprising:

a display panel including a display part which arranges video signal lines and scanning signal lines in a matrix array and has pixels at crossing portions of the video signal lines and the scanning signal lines, and a video signal line driving circuit which supplies display data to the video signal lines and a scanning signal line driving circuit which supplies scanning signals to the scanning signal lines on a periphery of the display part, and a display control circuit including a timing controller which has an input data processing circuit which generates display data for displaying images on the display panel based on video data inputted from an external signal source and timing signals and an output data processing circuit which outputs the display data to the video signal line driving circuit, wherein the display control circuit includes:

a memory which stores video data for a plurality of frames which are outputted from the input data processing circuit;

a clock synthesizer which generates a 2 m multiplied (m being an integer of 2 or more) clock signal for reading out the video data from the memory by multiplying an input clock signal inputted from the outer signal source, and a brightness comparison circuit which compares video data between an nth frame and an (n+1)th frame stored in the memory for every pixel display unit and outputs a display instruction signal which instructs a display of first display data or second display data to the output data processing circuit, wherein video data of the nth frame stored in the memory are outputted to the video signal line driving circuit as display data of a first field, and the first display data or the second display data corresponding to the display instruction signal are outputted to the video signal line driving circuit as display data of a second field, and wherein the multiplying number 2 m of the clock synthesizer is 4 and the memory is constituted of two frame memories each of which stores the video signal for one frame.

4. A display device comprising:

a display panel including a display part which arranges video signal lines and scanning signal lines in a matrix array and has pixels at crossing portions of the video signal lines and the scanning signal lines, and a vide signal line driving circuit which supplies display data to the video signal lines and a scanning signal line driving circuit which supplies scanning signals to the scanning signal lines on a periphery of the display part, and a display control circuit including a timing controller which has an input data processing circuit which generates display data for displaying images on the display panel based on video data inputted from an external signal source and timing signals and an output data processing circuit which outputs the display data to the video signal line driving circuit, wherein the display control circuit includes:

a memory which stores video data for a plurality of frames which are outputted from the input data processing circuit;

a clock synthesizer which generates a 2 m multiplied (m being an integer of 2 or more) clock signal for reading out the video data from the memory by multiplying an input clock signal inputted from the outer signal source, and a brightness comparison circuit which sets the video data of an nth frame stored in the memory as display data of a first field, compares brightness of the video data of an (n+1)th frame stored in the memory with a given value for every pixel display unit and outputs a display instruction signal which instructs a display of first display data when the brightness is higher than the given value and a display of second display data to the output data processing circuit when the brightness is lower than the given value, wherein video data of the nth frame stored in the memory are outputted to the video signal line driving circuit as display data of the first field, and the first display data or the second display data corresponding to the display instruction signal are outputted to the video signal line driving circuit as display data of a second field, and wherein the display unit indicates a dot which displays red possessed by the pixel, the first display data are data which display red and the second display data are data which display black.

5. A display device according to claim 3 or claim 4, wherein the multiplying number 2 m of the clock synthesizer is 2 and the memory is constituted of three frame memories each of which stores the video signal for one frame.

6. A display device according to claim 4, wherein the multiplying number 2 m of the clock synthesizer is 4 and the memory is constituted of two frame memories each of which stores the video signal for one frame.

7. A display device according to claim 3 or claim 4, wherein the display unit indicates the pixel, the first display data are data which display white and the second display data are data which display black.

8. A display device according to claim 3, wherein the display unit indicates a dot which displays red possessed by the pixel, the first display data are data which display red and the second display data are data which display black.

9. A display device according to claim 3 or claim 4, wherein the display unit indicates a dot which displays red possessed by the pixel, a dot which displays green possessed by the pixel and a dot which displays blue possessed by the pixel respectively, the first display data are data which display respective colors which the respective dots display, and the second display data are data which display black.

* * * * *